US007951051B1

(12) United States Patent
Brown

(10) Patent No.: US 7,951,051 B1
(45) **Date of Patent: *May 31, 2011**

(54) VARIABLE RESISTANCE EXERCISE DEVICE

(76) Inventor: Gordon L. Brown, Anderson, SC (US)

( * ) Notice: Subject to any disclaimer, the term of this patent is extended or adjusted under 35 U.S.C. 154(b) by 20 days.

This patent is subject to a terminal disclaimer.

(21) Appl. No.: 12/644,392

(22) Filed: Dec. 22, 2009

Related U.S. Application Data

(63) Continuation-in-part of application No. 10/685,067, filed on Oct. 14, 2003, now Pat. No. 7,704,198.

(51) Int. Cl.
*A63B 21/00* (2006.01)

(52) U.S. Cl. ..... 482/126; 482/121; 482/91; 482/111; 482/112

(58) Field of Classification Search ..... 482/126, 482/121, 91, 111, 112, 11
See application file for complete search history.

(56) References Cited

U.S. PATENT DOCUMENTS

| | | | | |
|---|---|---|---|---|
| 1,678,642 | A | 7/1928 | Johnson | 206/769 |
| 2,189,556 | A * | 2/1940 | Younghusband | 206/209 |
| 3,246,893 | A | 4/1966 | Dale | 482/24 |
| 3,510,130 | A | 5/1970 | Ferdinand | 482/46 |
| 4,188,959 | A * | 2/1980 | Karalius | 131/245 |
| 4,863,159 | A | 9/1989 | Brown | 272/93 |
| 5,004,226 | A | 4/1991 | Brown | 272/93 |
| 6,062,382 | A | 5/2000 | Czerkie | 206/315.11 |
| D427,651 | S | 7/2000 | Bodman | D21/662 |
| 6,379,286 | B1 | 4/2002 | Scopino | 482/93 |
| 6,432,029 | B1 | 8/2002 | Almeda | 482/140 |
| 6,872,174 | B2 | 3/2005 | Benach | 482/121 |

* cited by examiner

*Primary Examiner* — Jerome W Donnelly
(74) *Attorney, Agent, or Firm* — Joseph T. Guy; Nexsen Pruet, LLC

(57) ABSTRACT

An flexible elongated device for use in human exercise routines or as an implement having an elongated pultruded plastic rod or rods fitting loosely within a plastic tube. At least one of the rods is rectangular in cross section and the tube may be covered by a soft foam plastic sleeve. The rod may be produced by the pultrusion process.

52 Claims, 4 Drawing Sheets

VARIABLE RESISTANCE EXERCISE DEVICE

RELATED APPLICATIONS

The application is a Continuation-in-Part of U.S. Pat. No. 7,704,198 issued Apr. 4, 2010 from U.S. patent application Ser. No. 10/685,067 filed Oct. 14, 2003 which is incorporated herein.

FIELD OF INVENTION

The disclosed invention relates to an apparatus designed to assist in exercises and activities typically encountered on a daily basis whether intended to firm, strengthen and tone a person's abdominal muscles, arm muscles and other muscles of the body or when used as a functional device. When bent the device creates resistance against the bending force which renders the device ideal for exercise. The disclosed apparatus defines a flexible elongated device which is easy for an individual to handle in that it bends in any direction in response to the forces applied to the ends of the device, or to the center of the device with the hands holding the ends, or to the ends of the device with the hand or hands positioned at or near the center of the apparatus. Also, as the apparatus bends the external shape of the apparatus changes slightly to an oval shape such that as the flat part of the oval contacts a body component, such as the thigh, a greater degree of comfort will be felt by the user.

BRIEF SUMMARY OF THE INVENTION

It is a principal object of this invention to provide an elongated variable resistant flexible device, which is particularly suitable for exercise, that is easy to assemble and which bends in any direction when bent, the device preferably includes a flexible tube having rounded interior in which an elongated rod with a rectangular cross section is inserted. When the exercise device is held by the user's hands at or near the ends of the device or positioned on a modified piece of exercise equipment, such as an 'ParaBody 900 ST abdominal contractor', and a force is applied to the ends of the device, or to the center of the device, the device will readily bend in the intended direction as increased resistance is provided, as the distance between the ends of the device is reduced, with a resulting enhancement of the strengthening, conditioning and toning of the targeted muscles.

It is an additional objective to provide a greater degree of comfort to the user by having the exterior of the flexible elongated device deform slightly to an oval shape when bent such that the flat part of the oval shape spreads the resistance forces over a wider area of contact with the user's body producing a more comfortable feeling. This feature is due to the use of a flexible extruded thermoplastic tube having an essentially round section cavity into which the pultruded rod loosely fits such that when the thermoplastic tube bends its shape is altered to an oval.

A preferred embodiment features an extruded thermoplastic tubular component such as extruded PVC or a thermoplastic rubber tube that has a round or nearly round section cavity. The thermoplastic tube has a durometer such that the exercise device feels comfortable when placed onto the surface of a person's body such as the front of the person's thigh. It should not be too hard but can be somewhat hard given the fact that the thermoplastic tubular device will deform to an approximate oval cross sectional shape when bent. Into the cavity of the tube there is inserted a pultruded rod having, preferably, a consistent rectangular cross-section shape extending substantially the length of the extruded thermoplastic round tube. The rod fits easily into the cavity of the extruded thermoplastic round tube and is able to rotate freely about its longitudinal axis when inside the cavity of the straight extruded thermoplastic tube. End caps are placed on each end of the tube. When the tube is bent the rectangular section rod will automatically orient itself to bend about its major cross section axis.

Yet another embodiment is provided in a flexible elongated device having variable resistance to bending in any direction. The device comprises an elongated tube having opposite ends and a cylindrical interior surface defining a round section cavity with the tube being bendable in the shape of a semicircle without kinking when bending forces are applied to the tube. Also provided is an elongated flexible rod fitting loosely within the round section cavity and extending longitudinally substantially coextensive with a length of the tube wherein the rod provides the device with primary bending resistance and the rod has a cross section shape with a major axis and a minor axis wherein the major axis has a cross section which is greater than a cross section of the minor axis. In response to bending force exerted on the tube the rod rotatively orients to bend about the major axis in a direction in which the tube is bent. A closure is on each of the ends of the tube.

Yet another embodiment is provided in a flexible elongated device having variable resistance to bending in any direction. The device comprises an elongated extruded flexible thermoplastic tube having opposite ends and a cylindrical interior surface defining a round section cavity with the tube being bendable in the shape of a semicircle without kinking when bending forces are applied to the ends by grasping at or near the ends. Further provided is an elongated pultruded flexible rod fitting loosely within the round section cavity and extending longitudinally substantially coextensive with a length of the tube wherein the rod provides the device with primary bending resistance. The rod has a rectangular cross section with a major axis and a minor axis wherein the major axis dimension of the cross section of the rod is larger than the minor axis dimension of the cross section of the rod. The rod rotatively orients to a bend about the major axis in a direction in which the tube is bent in response to forces exerted against the rod by the cylindrical interior surface of the tube. A functional closure is on at least one end of the tube. A soft sleeve covers at least nearly the entire length of the tube.

In a particularly preferred embodiment the end closures, also referred to as end caps, are functional thereby affording the use with a great deal of flexibility with regards to the manner in which the device is used.

BRIEF DESCRIPTION OF THE DRAWINGS

The invention is illustrated in the accompanying drawings, in which.

DETAILED DESCRIPTION OF THE INVENTION

Figure 1:
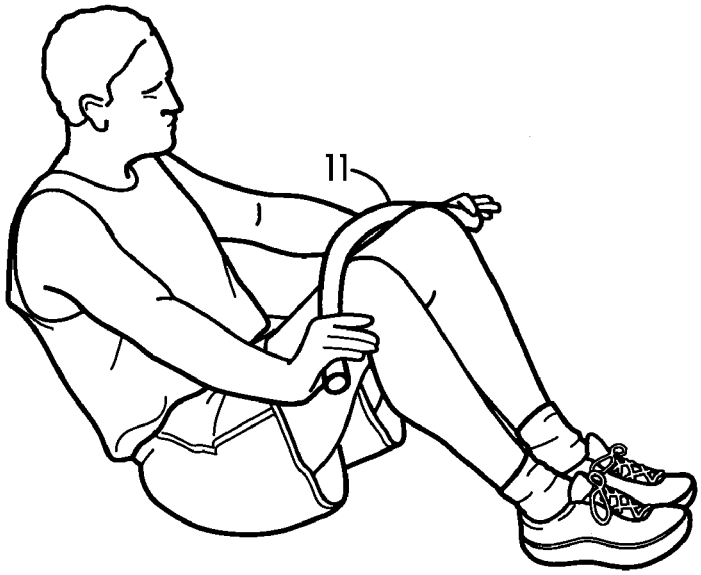
FIG. 1 shows an individual performing an exercise routine using a flexible exercise device.
Figure 2:
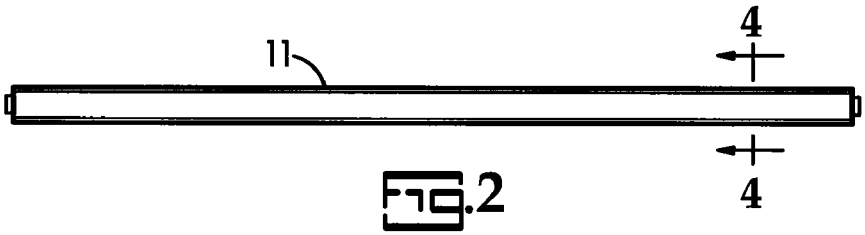
FIG. 2 is a side view of the exercise device.
Figure 3:
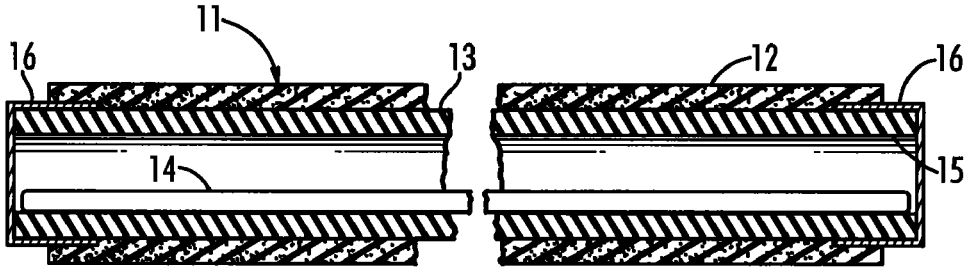
FIG. 3 is a longitudinal section of the exercise device of FIG. 2.
Figure 4:
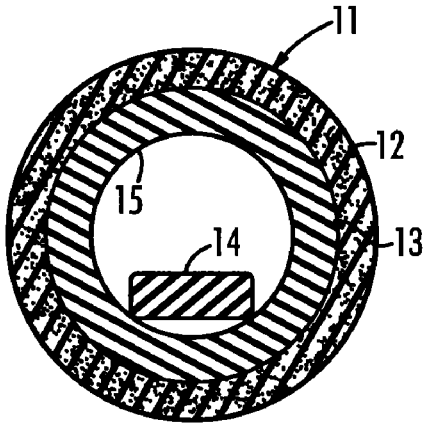
FIG. 4 is a section taken on line 4-4 in FIG. 2.
Figure 5:
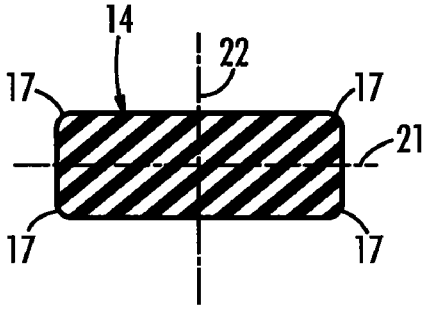
FIG. 5 is an enlarged section of a pultruded rectangular cross section rod.

The invention is hereinafter described in detail by reference to the accompanying drawings. The invention is not intended to be limited to the embodiments described; rather, this detailed description is included to enable any person skilled in the art to produce a flexible elongated exercise device which will bend in any direction when each end is grasped by the user at or near each end with a force applied to each end of the device; or with the hands grasping each end and applying a force to each end with the center of the device pressed against a part of the body such as the thigh(s); or with the hand or hands positioned at or near the center of the device and the hands applying a force at or near the center of the device with the ends of the device positioned in contact with each of the thighs slightly above the knee.

In a preferred embodiment the flexible device 11, is particularly suitable for use in exercise. As shown in FIGS. 1-5, the device includes a soft foam plastic tubular sleeve 12, a cylindrical tube 13 and an elongated substantially rectangular section pultruded composite rod 14. The rod 14 is preferably made from a group of mixtures including a mixture of thermoplastic resin and longitudinally oriented continuous glass fiber filaments and a mixture of thermoset resin and longitudinally oriented continuous glass fiber filaments. The rod 14 is designed to be bent into the shape of a semi-circle a minimum of 10,000 times without substantial cracking of the elongated rectangular shape. A material having low hysteresis is preferred for consistency. Suitable end closures, such as plastic caps 16, are installed on the ends of the tube 13. A suitable elongated exercise device 11 for many exercise routines will be about 36 inches in length with an outside diameter of about 1 5/16 inches. A pultruded composite rod 14 for such a device will have dimensions of 0.1875 inch×0.500 inch×35¾ inches with the full radius edges 17 over the length of the pultruded composite rod 14. The exercise device has a wide range of applications and may be 18 to 72 inches in length and from one half to 3 inches in diameter. The rod 14 has a major axis 21 and a minor axis 22 and may be constructed using PPG Industries, Inc. of Shelby, N.C. "E-glass" continuous fibers with the resin matrix being a vinyl ester resin. The fiber content is preferably 25% to 70% of the volume of the rod. The resin could alternatively be an epoxy resin, isophthalic polyester, PVC plastisol or other resin selected to give an acceptable flexural modulus and flexural fatigue performance in bending as well as minimal creep. A suitable composite rod is made by Glasforms, Inc. of San Diego, Calif. The soft, one piece smooth surface foam sleeve 12, available from Hunt-Wilde Corp. of Tampa, Fla., is slid over the outside of the extruded flexible PVC annular section tube 13 to cover substantially the full length of the extruded flexible PVC thermoplastic round tube 13 to give the exterior of the device 11 a soft feel against the individual's legs, thighs and hands. The extruded flexible PVC round tube 13, with a durometer of approximately 92 as measured on the Shore A scale, is made by Agricultural Products, Inc. of Ontario, Calif. The rod 14 provides variable resistance as the exercise device is bent. The pultruded composite rod 14 is inserted into the essentially cylindrical cavity of the extruded flexible PVC thermoplastic tube 13 defined by a radially inward facing cylindrical surface 15. The pultruded rectangular cross section rod 14 is easily inserted into the cavity of the tube 13 without deforming the shape of the tube 13 and removable closure 16 such as PVC end caps from Harman Corporation of Rochester, Mich. are placed over the ends of the tube 13. The closures 16 may be secured, as by an adhesive, if desired. The rod 14 is no longer than the tube 13.

Figure 6:
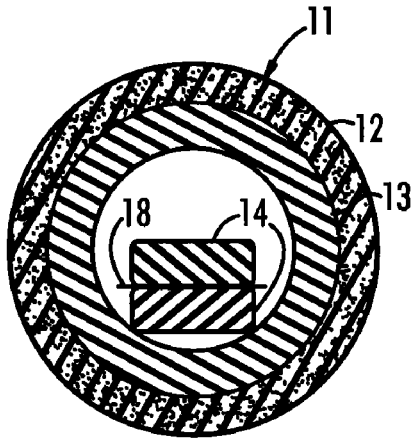
FIG. 6 is a section similar to FIG. 4 showing an embodiment of the invention having rectangular section rods in the hollow tube of the exercise device.

If an exercise device requiring greater bending force is desired an additional rod 14 may be inserted in the tube 13 as shown in FIG. 6. When the tube 13 is bent, both of the rods will orient themselves to bend about their major cross sectional axes. Friction between the rods 14 during bending may be reduced by inserting a 1 to 6 millimeter thick polyethylene thermoplastic strip 18 between the rods 14. The interleaved strip 18 may be slightly wider and as long as the rods 14.

Figure 7:
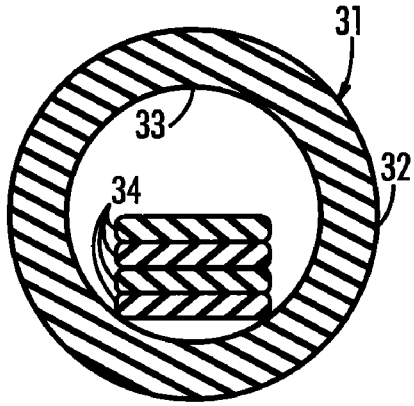
FIG. 7 is a section of an embodiment of the exercise device without a soft outer sleeve and having four rectangular cross section rods in a hollow tube.
Figure 8:
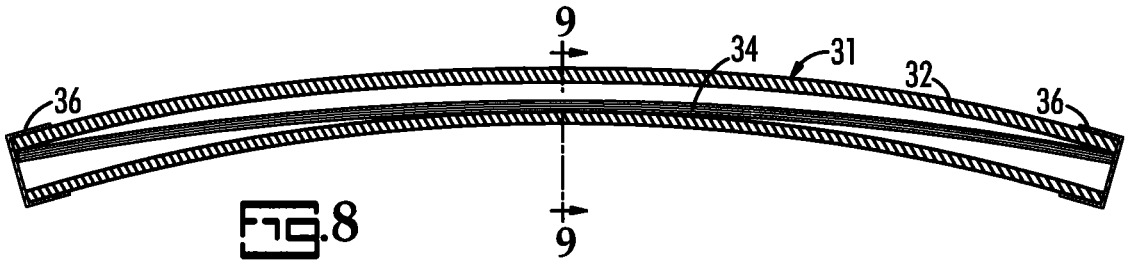
FIG. 8 is a longitudinal section showing the device of FIG. 7 bent as occurs in an exercise routine.
Figure 9:
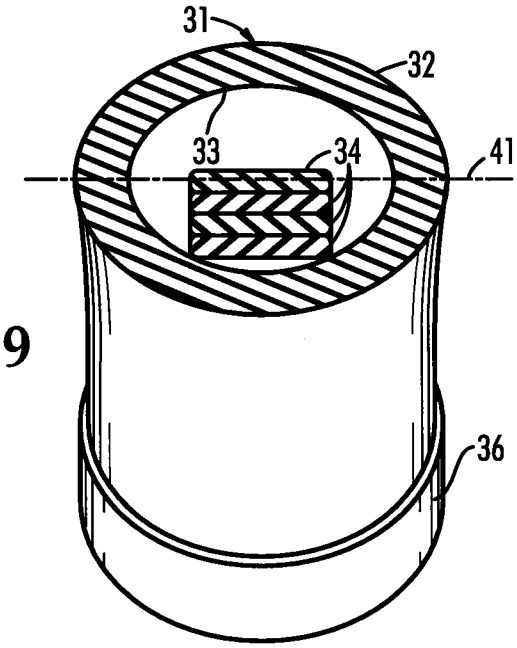
FIG. 9 is a section taken on line 9-9 in FIG. 8.

An alternative device 31, also particularly suitable for use in exercise, shown in FIGS. 7, 8 and 9, has a larger outside diameter extruded flexible PVC thermoplastic tube 32 than the extruded flexible PVC thermoplastic tube 13 shown in FIGS. 2, 3, 4 and 6. The inside diameter of the alternate exercise device 31 can be tailored to accommodate a wider range of sizes of rectangular cross section rods than are accommodated in the extruded flexible thermoplastic tube 13. The tube 32 has a surface hardness in the range of 50 to 100 as measured by the Shore A scale. Four pultruded rectangular cross section rods 34 are inserted in the tube 32 of the alternative exercise device 31. Closures in the form of end caps 36 are then installed on the ends of the tube 32. The rods 34 are thinner in the direction of their minor axis than the rods 14 and have a greater flexural endurance than the rods 14.

Figure 10:
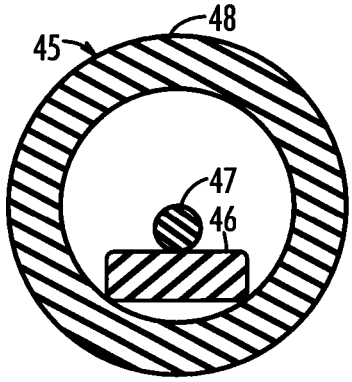
FIG. 10 is a section showing a round rod and a rectangular cross section rod in a hollow tube.

FIG. 10 shows a rectangular cross section rod 46 and a round cross section rod 47 fitting loosely in a flexible PVC thermoplastic tube 48. The round cross section rod 47 may be added when a slightly stiffer exercise device 45 is desired.

When the complete device is bent by the hands applying a force at or near each end of the device, the extruded PVC thermoplastic tube 13, 32 or 48 deforms as shown in FIG. 8 without kinking and with the pultruded composite rod, or rods, orienting itself, or themselves during the initial phase of the bending in response to forces exerted on the lengthwise edges by the interior cavity surface of the extruded flexible PVC thermoplastic round tube as its mid section deforms slightly to an oval section as shown in FIG. 9 such that the pultruded composite rod or rods and the tube of the exercise device bend readily in the direction that the device is bent in response to the forces exerted on the ends of the device by the hands. In the bending exercise of the device 11, 31 or 45, the pultruded composite rod or rods will orient itself or themselves to bend about its axis or major axis 21 which is approximately parallel to the major axis 41 of the oval section shape of the deformed tube 32 as shown in FIG. 9.

Prior to insertion of the pultruded composite rod into the cavity of the tube, the rod may have a wax, such as carnauba wax, applied to its surface which allows the rod to move easier inside the cavity of the tube as the rod orients itself so it can bend around its major axis as the tube is bent by the application of forces at or near each end of the exercise device. Further, a lubricant spray, such as WD-40, may be sprayed into the cavity of the tube, instead of applying the carnauba wax to the pultruded rod, prior to or after insertion of the rod in the cavity and before the application of the end caps to permit the pultruded bar to move easier inside the cavity of the tube as the rod orients itself so it can bend around its major axis upon the application of bending forces to the exercise device.

The pultruded rectangular cross section rods 14 and 34 will automatically orient themselves in the tube by bending about their major cross sectional axes during the initial bending of the exercise device. The extruded flexible tube's material density and surface hardness can be varied as long as the extruded tubular shape does not kink when bent at least into the shape of a semi-circle or interfere with the pultruded rod's natural tendency to orient itself to bend around it's major cross sectional axis. Even when multiple rods are used, as shown in FIGS. 6 and 7, the rods will orient themselves to bend about their major cross sectional axes as the exercise device is bent during an exercise routine. The use of a plurality of thin rods 34 allows the exercise device to be tailored to individual requirements. A slight increase in bending resistance can easily be achieved by the addition of one or more small diameter rods 47. The addition of small diameter rods 47 does not prevent the rectangular cross section rods from orienting themselves to bend about their major axes.

Figure 11:
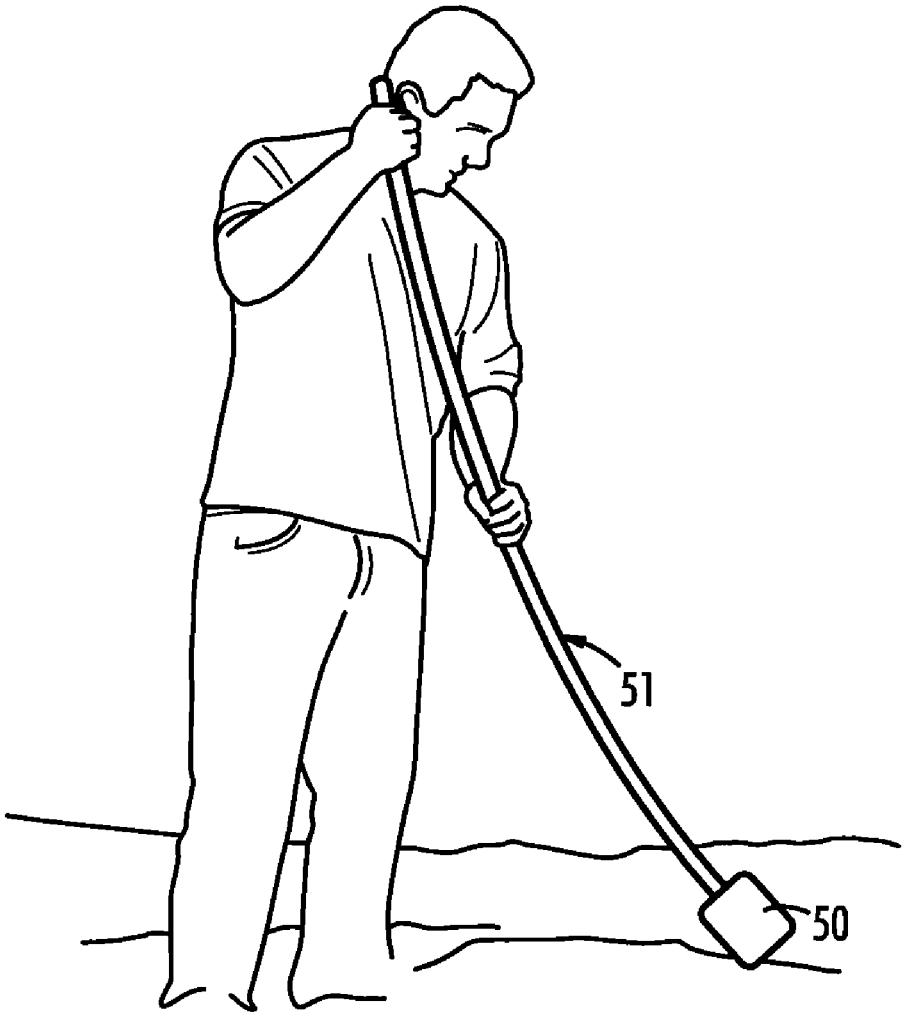
FIG. 11 shows an individual using the device as an implement.
Figure 12:
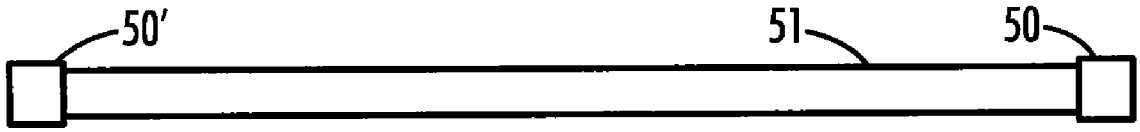
FIG. 12 shows, schematically, an embodiment of the invention.

A preferred embodiment is illustrated in FIG. 11 wherein the device is used as an implement. In FIG. 11 the flexible device, 51, is as illustrated and described above as element 11 or 31. The closure, as described above, is replaced with a functional closure, 50. The functional closure is an element which seals the end of the elongated device to insure that the rods contained therein are maintained within the cylindrical tube yet the closure has additional elements integral thereto which provides additional functionality to the device. Functional closures preferably include at least one element selected from the group consisting of a shovel, a rake, a hoe, a fork, a post, a hook, a circular eye and a decorative element.

Shovels, rakes, hoes and forks are well known elements for dislodging, moving and reorienting sod, mulch, leaves, dirt and other materials, particularly, landscaping materials. The device is particularly suitable for such use since the flexibility of tube allows the device to be run over by a vehicle, stepped on, etc. without breaking and as pressure is applied the inner rods will support the external tubes. The device is therefore resistive to breaking while still being light and comfortable to grip. In particular, the instant invention allows the device to be strong and light weight.

Post, hooks and circular eyes allow the device to be inserted into the ground, or a void, thereby allowing for use as a pole which is either standing or hanging. The device can be used as a display, such as a flag pole, or as a flexible barrier such as in ski gates and the like which will bend yet return to their straight position upon release of any perturbing weight. A decorative element can be employed if desired such as an eagle if the device is used as a flag pole.

There are additional advantages flowing from use of a plurality of relatively thin rectangular cross section rods. A thin rectangular cross section rod has a longer service life than a thick rectangular cross section rod and the use of a plurality of thin rectangular cross section rods make it easy to select the number of rods to match the stiffness desired or to change the stiffness for any reason during use.

What is claimed is:

1. A flexible elongated device having variable resistance to bending in any direction including:

an elongated tube having opposite ends and a cylindrical interior surface defining a round section cavity, said tube being bendable in the shape of a semicircle without kinking, when bending forces are applied to said tube, an elongated flexible rod fitting loosely within said round section cavity and extending longitudinally substantially coextensive with a length of said tube, said rod providing said device with primary bending resistance and said rod has a cross section shape with a major axis and a minor axis wherein said major axis has a cross section which is greater than a cross section of said minor axis, wherein in response to bending force exerted on said tube said rod rotatively orients to bend about said major axis in a direction in which said tube is bent; and a closure on each of said ends of said tube.

2. The flexible elongated device of claim 1 wherein at least one said closure is a functional closure.

3. A flexible elongated device having variable resistance to bending in any direction including:

an elongated tube having opposite ends and a cylindrical interior surface defining a round section cavity, said tube being bendable in the shape of a semicircle without kinking, when bending forces are applied to said tube, an elongated flexible rod fitting loosely within said round section cavity and extending longitudinally substantially coextensive with a length of said tube, said rod providing said device with primary bending resistance and said rod has a cross section shape with a major axis and a minor axis wherein said major axis has a cross section which is greater than a cross section of said minor axis, wherein in response to bending force exerted on said tube said rod rotatively orients to bend about said major axis in a direction in which said tube is bent; and a closure on each of said ends of said tube wherein at least one said closure is a functional closure selected from the group consisting of a shovel, a rake, a hoe, a fork, a post, a hook and a circular eye.

4. The flexible elongated device of claim 1 wherein said flexible elongated device has an exterior shape which is essentially cylindrical.

5. The flexible elongated device of claim 1 further comprising at least one additional rod fitting loosely in said tube, each said additional rod being made of one of a group of mixtures including a mixture of thermoplastic resin and longitudinally oriented continuous fibers, a mixture of thermoset resin and longitudinally oriented continuous fibers, a thermoplastic resin containing no fibers and a thermoplastic resin with chopped fibers.

6. The flexible elongated device of claim 5 wherein said additional rod is made of one of a group of mixtures including a mixture of thermoplastic resin and longitudinally oriented continuous fibers and a mixture of thermoset resin and longitudinally oriented continuous fibers.

7. The flexible elongated device of claim 6 wherein said longitudinally oriented continuous fibers are selected from the group consisting of type E glass fibers, type A glass fibers, type S-2 glass fibers, Owens Corning 'Advantex' glass fibers, type AR glass fibers, carbon fibers, aramid fibers and polyester fibers.

8. The flexible elongated device of claim 1 having at least one additional rod fitting loosely within and substantially coextensive with said tube, said additional rod having a rectangular cross section shape.

9. A flexible elongated device having variable resistance to bending in any direction including:

an elongated tube having opposite ends and a cylindrical interior surface defining a round section cavity, said tube being bendable in the shape of a semicircle without kinking, when bending forces are applied to said tube, an elongated flexible rod fitting loosely within said round section cavity and extending longitudinally substantially coextensive with a length of said tube, said rod providing said device with primary bending resistance and said rod has a cross section shape with a major axis and a minor axis wherein said major axis has a cross section which is greater than a cross section of said minor axis, wherein in response to bending force exerted on said tube said rod rotatively orients to bend about said major axis in a direction in which said tube is bent;

a closure on each of said ends of said tube; and having at least one additional rod fitting loosely within and substantially coextensive with said tube, said additional rod having a rectangular cross section shape and said flexible elongated device further comprises a thermoplastic strip interleaved between said rod and said additional rod.

10. The flexible elongated device of claim 1 wherein said interior surface defining said round section cavity of said flexible tube, when said tube is deformed by application of a bending force to each of its ends, will apply a pressure to edges on said rod along part of a length of said rod causing said rod to orient itself within said tube so that said rod will bend around said major axis without further change to an orientation of said tube.

11. The flexible elongated device of claim 1 wherein said rod is formed by pultrusion.

12. The flexible elongated device of claim 1 further comprising at least one additional rod of round cross section fitting loosely within and substantially coextensive with said tube.

13. A flexible elongated device having variable resistance to bending in any direction including:

an elongated extruded flexible thermoplastic tube having opposite ends and a cylindrical interior surface defining a round section cavity, said tube being bendable in the shape of a semicircle without kinking, when bending forces are applied to said ends by grasping at or near said ends;

an elongated pultruded flexible rod fitting loosely within said round section cavity and extending longitudinally substantially coextensive with a length of said tube, wherein said rod provides said device with primary bending resistance and said rod has a rectangular cross section with a major axis, a minor axis wherein said major axis dimension of said cross section of said rod is larger than said minor axis dimension of said cross section of said rod, wherein said rod rotatively orients to a bend about said major axis in a direction in which said tube of said device is bent in response to forces exerted against said rod by said cylindrical interior surface of said tube and a functional closure on at least one end of said tube; and having a soft sleeve covering at least a portion of said tube.

14. The flexible elongated device of claim 13 wherein said tube contains essentially no continuous reinforcing fibers.

15. The flexible elongated device of claim 13 wherein said rod has radiused longitudinal edges.

16. The flexible elongated device of claim 13 wherein said major axis dimension is at least one and one half times said minor axis dimension.

17. The flexible elongated device of claim 13 wherein at least one said closure is a functional closure.

18. The flexible elongated device of claim 17 wherein said functional closure is selected from the group consisting of a shovel, a rake, a hoe, a fork, a post, a hook, a circular eye and a decorative element.

19. The flexible elongated device of claim 13 said flexible elongated device has an exterior shape which is essentially cylindrical.

20. The flexible elongated device of claim 13 wherein said rod has a percent volume fraction of fiber of between 25% and 70%.

21. The flexible elongated device of claim 13 wherein at least one said closure is an end cap.

22. The flexible elongated device of claim 13 further comprising at least one additional rod fitting loosely in said tube, each additional rod being made of one of a group of mixtures including a mixture of thermoplastic resin and longitudinally oriented continuous fibers, a mixture of thermoset resin and longitudinally oriented continuous fibers, a thermoplastic resin containing no fibers and a thermoplastic resin with chopped fibers.

23. The flexible elongated device of claim 13 having at least one additional rod fitting loosely within and substantially coextensive with said tube, said additional rod having a rectangular cross section shape.

24. The flexible elongated device of claim 23 further comprising a strip of thermoplastic interleaved between said rod and said additional rod.

25. The flexible elongated device of claim 22 wherein said additional rod is made of one of a group of mixtures including a mixture of thermoplastic resin and longitudinally oriented continuous fibers and a mixture of thermoset resin and longitudinally oriented continuous fibers.

26. The flexible elongated device of claim 25 wherein said longitudinally oriented continuous fibers are selected from the group consisting of type E glass fibers, type A glass fibers, type S-2 glass fibers, Owens Corning 'Advantex' glass fibers, type AR glass fibers, carbon fibers, aramid fibers and polyester fibers.

27. The flexible elongated device of claim 13 wherein said interior surface defining said round section cavity of said flexible tube, when said tube is deformed by application of a bending force to each of its ends, will apply a pressure to edges on said rod along part of a length of said rod causing said rod to orient itself within said tube so that said rod will bend around said major axis without further change to an orientation of said tube.

28. The flexible elongated device of claim 13 further comprising:

at least one additional rod of round cross section fitting loosely within and substantially coextensive with said tube.

29. A flexible elongated device having variable resistance to bending in any direction including:

an elongated extruded flexible thermoplastic tube having opposite ends and a cylindrical interior surface defining a round section cavity, said tube being bendable in the shape of a semicircle without kinking, when bending forces are applied to said ends by grasping at or near said ends;

an elongated pultruded flexible rod fitting loosely within said round section cavity and extending longitudinally substantially coextensive with a length of said tube, wherein said rod provides said device with primary bending resistance and said rod has a cross section with a major axis, a minor axis wherein said major axis dimension of said cross section of said rod is larger than said minor axis dimension of said cross section of said rod, wherein said rod rotatively orients to bend about said major axis in a direction in which said tube of said device is bent in response to forces exerted against said rod by said cylindrical interior surface of said tube; and a functional closure on at least one end of said tube.

30. The flexible elongated device of claim 29 wherein said functional closure is selected from the group consisting of a shovel, a rake, a hoe, a fork, a post, a hook, a circular eye and a decorative element.

31. The flexible elongated device of claim 29 wherein said flexible elongated device has an exterior shape which is essentially cylindrical.

32. The flexible elongated device of claim 29 further comprising at least one additional rod fitting loosely in said tube, each said additional rod being made of one of a group of mixtures including a mixture of thermoplastic resin and longitudinally oriented continuous fibers, a mixture of thermoset resin and longitudinally oriented continuous fibers, a thermoplastic resin containing no fibers and a thermoplastic resin with chopped fibers.

33. The flexible elongated device of claim 32 wherein said additional rod is made of one of a group of mixtures including a mixture of thermoplastic resin and longitudinally oriented continuous fibers and a mixture of thermoset resin and longitudinally oriented continuous fibers.

34. The flexible elongated device of claim 33 wherein said longitudinally oriented continuous fibers are selected from the group consisting of type E glass fibers, type A glass fibers, type S-2 glass fibers, Owens Corning 'Advantex' glass fibers, type AR glass fibers, carbon fibers, aramid fibers and polyester fibers.

35. The flexible elongated device of claim 29 having at least one additional rod fitting loosely within and substantially coextensive with said tube, said additional rod having a rectangular cross section shape.

36. The flexible elongated device of claim 35 further comprising a thermoplastic strip interleaved between said rod and said additional rod.

37. The flexible elongated device of claim 29 wherein said interior surface defining said round section cavity of said flexible tube, when said tube is deformed by application of a bending force to each of its ends, will apply a pressure to edges on said rod along part of a length of said rod causing said rod to orient itself within said tube so that said rod will bend around said major axis without further change to an orientation of said tube.

38. The flexible elongated device of claim 29 wherein said rod is formed by pultrusion.

39. The flexible elongated device of claim 29 further comprising at least one additional rod of round cross section fitting loosely within and substantially coextensive with said tube.

40. The flexible elongated device of claim 29 further comprising a soft sleeve covering at least a portion of said tube.

41. A flexible elongated device having variable resistance to bending in any direction including:

an elongated extruded flexible thermoplastic tube having opposite ends and a cylindrical interior surface defining a round section cavity, said tube being bendable in the shape of a semicircle without kinking, when bending forces are applied to said ends by grasping at or near said ends;

an elongated flexible rod with a percent volume fraction of fiber of between 25% and 70% fitting loosely within said round section cavity and extending longitudinally substantially coextensive with a length of said tube, wherein said rod provides said device with primary bending resistance and said rod has a cross section with a major axis, a minor axis wherein said major axis dimension of said cross section of said rod is larger than said minor axis dimension of said cross section of said rod, wherein said rod rotatively orients to bend about said major axis in a direction in which said tube of said device is bent in response to forces exerted against said rod by said cylindrical interior surface of said tube; and a functional closure on at least one end of said tube.

42. The flexible elongated device of claim 41 wherein said functional closure is selected from the group consisting of a shovel, a rake, a hoe, a fork, a post, a hook, a circular eye and a decorative element.

43. The flexible elongated device of claim 41 wherein said flexible elongated device has an exterior shape which is essentially cylindrical.

44. The flexible elongated device of claim 41 further comprising at least one additional rod fitting loosely in said tube, each said additional rod being made of one of a group of mixtures including a mixture of thermoplastic resin and longitudinally oriented continuous fibers, a mixture of thermoset resin and longitudinally oriented continuous fibers, a thermoplastic resin containing no fibers and a thermoplastic resin with chopped fibers.

45. The flexible elongated device of claim 44 wherein said additional rod is made of one of a group of mixtures including a mixture of thermoplastic resin and longitudinally oriented continuous fibers and a mixture of thermoset resin and longitudinally oriented continuous fibers.

46. The flexible elongated device of claim 45 wherein said longitudinally oriented continuous fibers are selected from the group consisting of type E glass fibers, type A glass fibers, type S-2 glass fibers, Owens Corning 'Advantex' glass fibers, type AR glass fibers, carbon fibers, aramid fibers and polyester fibers.

47. The flexible elongated device of claim 41 having at least one additional rod fitting loosely within and substantially coextensive with said tube, said additional rod having a rectangular cross section shape.

48. The flexible elongated device of claim 47 further comprising a thermoplastic strip interleaved between said rod and said additional rod.

49. The flexible elongated device of claim 41 wherein said interior surface defining said round section cavity of said flexible tube, when said tube is deformed by application of a bending force to each of its ends, will apply a pressure to edges on said rod along part of a length of said rod causing said rod to orient itself within said tube so that said rod will bend around said major axis without further change to an orientation of said tube.

50. The flexible elongated device of claim 41 wherein said rod is formed by pultrusion.

51. The flexible elongated device of claim 41 further comprising at least one additional rod of round cross section fitting loosely within and substantially coextensive with said tube.

52. The flexible elongated device of claim 41 further comprising a soft sleeve covering at least a portion of said tube.

* * * * *